US008616903B2

(12) United States Patent
Li et al.

(10) Patent No.: US 8,616,903 B2
(45) Date of Patent: Dec. 31, 2013

(54) CARD EDGE CONNECTOR HAVING IMPROVED EJECTOR

(75) Inventors: Zhuang-Xing Li, Kunshan (CN); Xiao-Zhi Fu, Kunshan (CN); Xue-Hai Shen, Kunshan (CN); Ze-Lin Yao, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 9 days.

(21) Appl. No.: 13/528,872

(22) Filed: Jun. 21, 2012

(65) Prior Publication Data

US 2012/0329301 A1 Dec. 27, 2012

(30) Foreign Application Priority Data

Jun. 24, 2011 (CN) ..... 2011 2 0217741 U

(51) Int. Cl.
*H01R 13/62* (2006.01)

(52) U.S. Cl.
USPC ..... 439/157

(58) Field of Classification Search
USPC ..... 439/157, 160, 327
See application file for complete search history.

(56) References Cited

U.S. PATENT DOCUMENTS

| | | | | |
|---|---|---|---|---|
| 5,746,614 | A | 5/1998 | Cheng et al. | |
| 6,113,404 | A * | 9/2000 | Choy | 439/160 |
| 6,599,142 | B2 * | 7/2003 | Bu | 439/157 |
| 6,616,466 | B2 * | 9/2003 | Frantum et al. | 439/157 |
| 7,210,955 | B2 * | 5/2007 | Ringler et al. | 439/381 |
| 7,233,500 | B2 * | 6/2007 | Yu | 361/737 |
| 7,494,354 | B2 | 2/2009 | Mon et al. | |
| 7,500,863 | B2 * | 3/2009 | Ringler et al. | 439/327 |
| D627,740 | S | 11/2010 | Wu et al. | |
| 7,828,566 | B2 * | 11/2010 | Chen et al. | 439/157 |
| 7,922,506 | B1 | 4/2011 | Harlan et al. | |
| 7,955,098 | B1 * | 6/2011 | McKee et al. | 439/157 |
| 8,070,499 | B2 * | 12/2011 | Guan et al. | 439/155 |

* cited by examiner

*Primary Examiner* — Neil Abrams
*Assistant Examiner* — Phuongchi T Nguyen
(74) *Attorney, Agent, or Firm* — Wei Te Chung; Ming Chieh Chang

(57) ABSTRACT

A card edge connector (100) includes an insulative housing, a set of contacts (2) retained in the insulative housing and an ejector (3). The insulative housing has a central slot (12) and at least one tower portion (13). The tower portion includes a pair of outer walls (131) and a receiving slot (135) formed between the outer walls. Each outer wall has a ladder with a circular hole (1312) formed therein. The ejector has a pair of spindles (312) received in the circular holes and a pair of standoffs (313). Each standoff has a horizontal surface (3131) abutting against a corresponding horizontal resisting surface (1314) formed on the ladder so as to make centers of the spindle and the circular hole overlap when the ejector rotates inwardly.

20 Claims, 10 Drawing Sheets

CARD EDGE CONNECTOR HAVING IMPROVED EJECTOR

BACKGROUND OF THE INVENTION

1. Field of the Invention

The present invention relates to a card edge connector, more particularly to a card edge connector having an improved ejector.

2. Description of Related Art

Card edge connectors are employed widely in computers to receive a memory module, graphic card, network interface et al. The card edge connector usually includes an elongated insulative housing defining a central slot for receiving the memory module, a plurality of contacts retained in the housing and projecting into the central slot for electrically mating with the memory module, and a pair of ejectors rotatablely attached to two tower portions formed at two longitudinal ends of the insulative housing for ejecting and latching with the memory module.

The ejectors usually have main portions, ejecting portions extending inwardly from lower ends of the main portions for ejecting the memory module out of the central slot, locking portions extending inwardly from upper ends of the main portions for latching with the memory module, and lever portions extending outwardly from the upper ends of the main portions and opposed to the locking portion for being operated by hands conveniently. The main portions usually have spindles rotatablely received in circular holes of the tower portions. However, each spindle has a diameter smaller than that of the circular hole, when the memory module is being inserted into the central slot, the ejectors rotates inwardly toward the central slot from an open position as a lower edge of the memory module pressing the ejecting portions downwardly, and the center of the spindle will be lower than the center of the circular hole because of the dimensional tolerance between the spindle and the circular hole, in this situation, the ejecting portion will shift down and not be pressed by the lower edge of the memory module during the insertion of the memory module, and when the memory module is completely inserted into the central slot, the ejectors could not rotate to scheduled positions and certainly will not latch the memory module effectively.

Hence, an improvement over the prior art is required to overcome the disadvantages thereof.

BRIEF SUMMARY OF THE INVENTION

According to one aspect of the present invention, a card edge connector comprises a longitudinal insulative housing, a plurality of contacts retained in the insulative housing for mating with the memory module and an ejector. The insulative housing has a central slot extending along a longitudinal direction for insertion of a memory module and at least one tower portion extending upwardly therefrom. The tower portion comprises a pair of outer walls extending along a height direction and a receiving slot formed between the outer walls. Each outer wall defines a ladder with a circular hole formed therein. The ejector is assembled to the tower portion and is rotatable inwardly or outwardly relative to the tower portion for latching the memory module into the central slot or ejecting the memory module out of the central slot. The ejector has a pair of spindles formed at two sides thereof in a transverse direction and being rotatablely received in the respective circular holes, and a pair of standoffs formed at the two sides thereof. Each standoff defines a horizontal surface abutting against a corresponding horizontal resisting surface formed on the ladder so as to make centers of the spindle of the ejector and the circular hole of the tower portion overlap when the ejector rotates inwardly.

According to another aspect of the present invention, a card edge connector comprises a longitudinal insulative housing, a plurality of contacts retained in the insulative housing for mating with the memory module and a pair of ejectors. The insulative housing has a central slot extending along a longitudinal direction for insertion of a memory module and a pair of tower portions extending upwardly from two longitudinal ends thereof. Each tower portion comprises a pair of outer walls extending along a height direction and a receiving slot formed between the outer walls. Each outer wall comprises a thick lower wall and a thin upper wall extending upwardly from the lower wall. The lower wall has a recess recessed at an upside thereof and a circular hole recessed on the recess. The ejectors are rotatablely received in the receiving slot in the longitudinal direction. Each ejector comprises a main portion, an ejecting portion extending from a lower end of the main portion for ejecting the memory module out of the central slot, a locking portion extending from an upper end of the main portion for latching the memory module into the central slot, and a lever portion extending from the upper end of the main portion and opposite to the locking portion for being handled by a hand or others easily. The main portion comprises an upper wide portion corresponding to the upper walls and a lower narrow portion corresponding to the lower walls. The narrow portion defines a pair of spindles formed at two sides thereof and is rotatablely received in the respective circular holes in a loose fit condition. The narrow portion of each ejector has a pair of standoffs formed at the two sides thereof, each standoff defines a horizontal surface abutting against a corresponding horizontal resisting surface formed at a bottom side of the recess so as to align centers of the corresponding spindle and circular hole when the ejector rotates inwardly.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
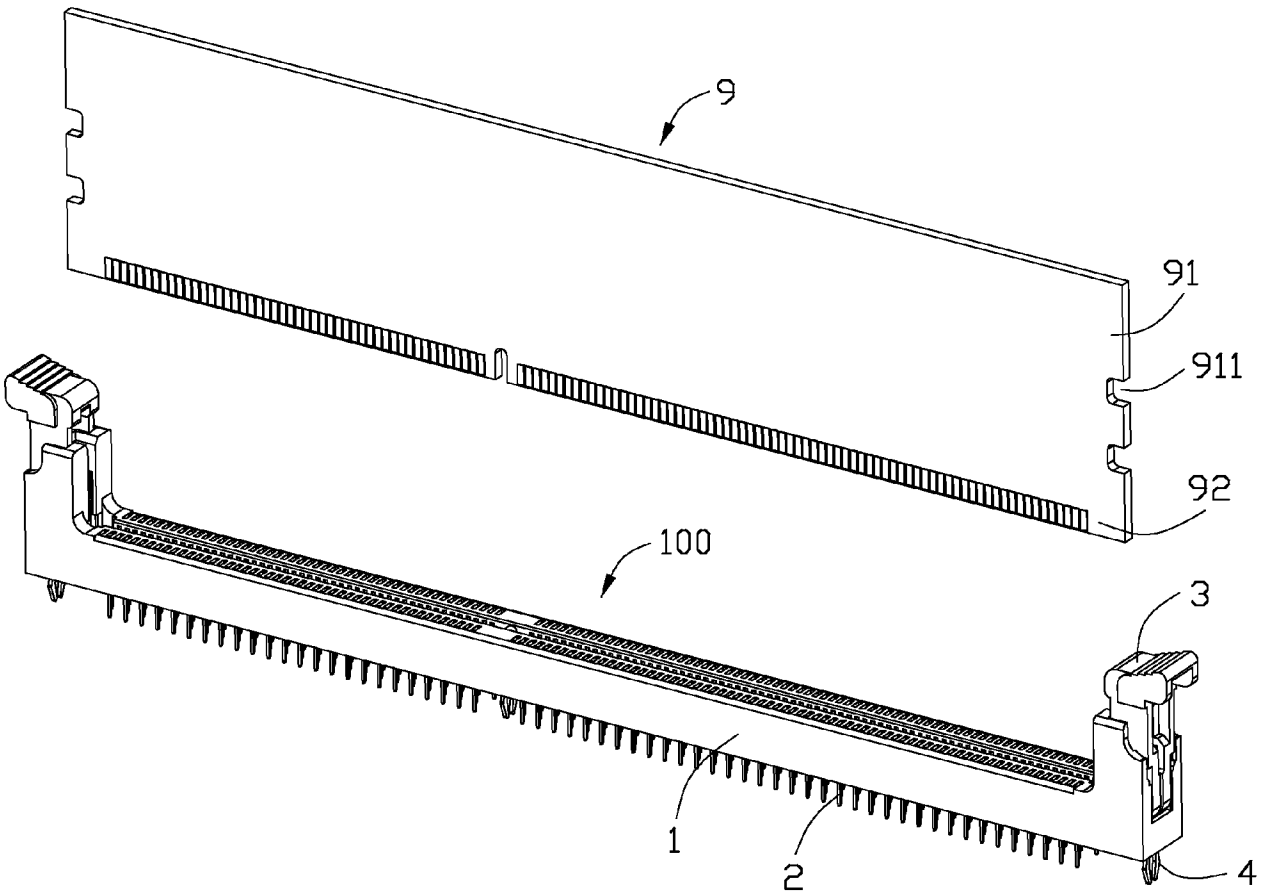
FIG. 1 is a perspective view of a card edge connector with a memory module for being inserted therein according to an embodiment of the present invention.
Figure 7:
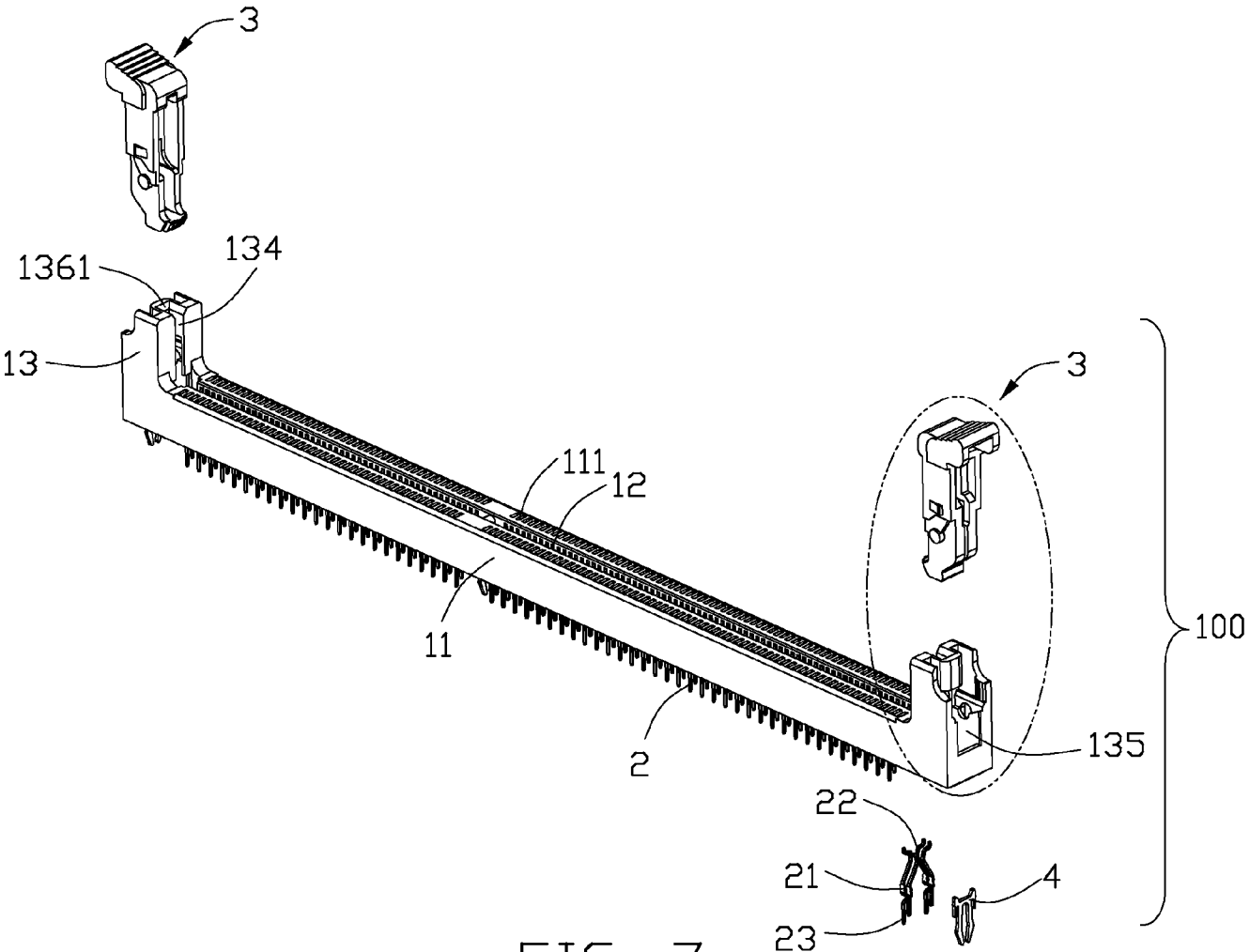
FIG. 7 is a partly exploded view of the card edge connector shown in FIG. 1.

Referring to FIGS. 1 and 7, a card edge connector 100 according to an embodiment of the present invention is used for being vertically mounted onto a printed circuit board (not shown) and adapted for insertion of a memory module 9. The card edge connector 100 comprises a longitudinal insulative housing 1, a set of contacts 2 retained in the insulative housing 1, a pair of ejectors 3 assembled to two longitudinal ends of the insulative housing 1, and a pair of board locks 4 assembled to the insulative housing 1 for being retained into the printed circuit board.

Figure 8:
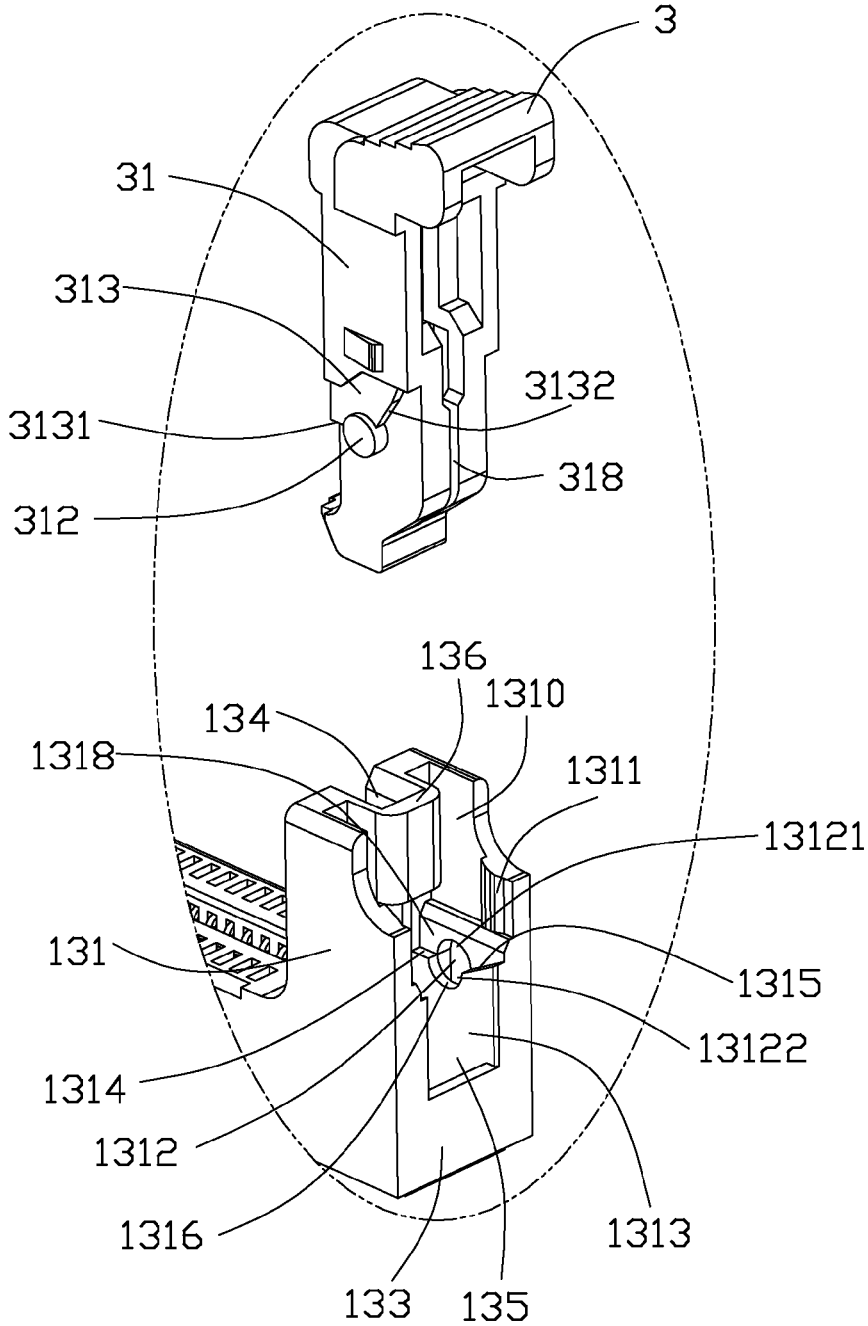
FIG. 8 is an enlarged view of a circle portion shown in FIG. 6.

Referring to FIGS. 7-8, the insulative housing 1 has a pair of side walls 11 extending along a longitudinal direction, a longitudinal central slot 12 located between the side walls 11 for insertion of the memory module 9, and a pair of tower portions 13 located at the two longitudinal ends thereof and extending upwardly beyond the side walls 11. Each side wall 11 has a plurality of cavities 111 arranged along the longitudinal direction and communicating with the central slot 12 in a transverse direction perpendicular to the longitudinal direction. The cavities 111 pass through the respective side walls 11 in a height direction perpendicular to both the transverse direction and the longitudinal direction.

Figure 2:
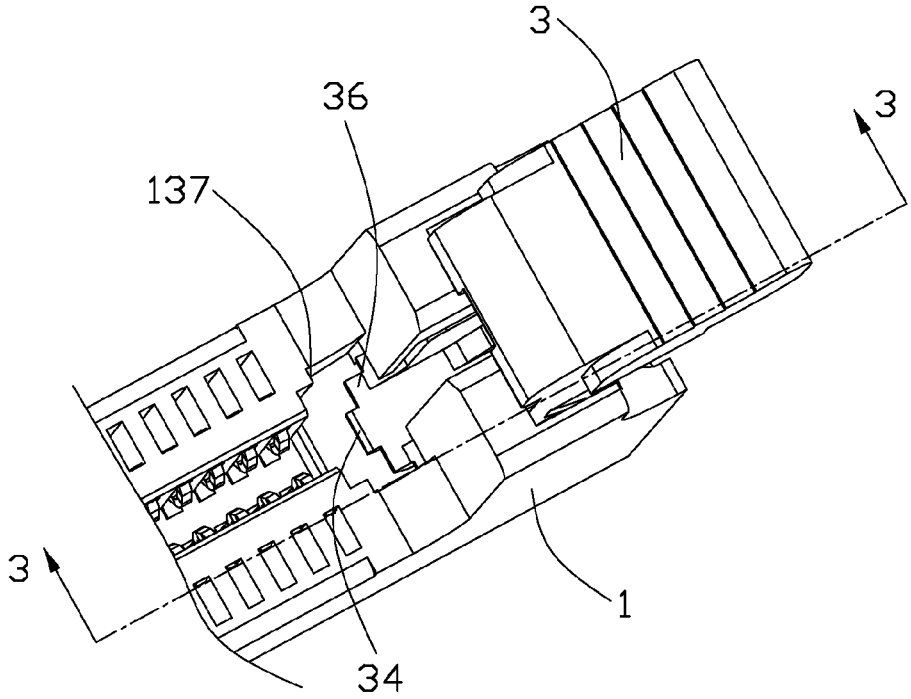
FIG. 2 is another perspective view of a part of the card edge connector shown in FIG. 1.
Figure 4:
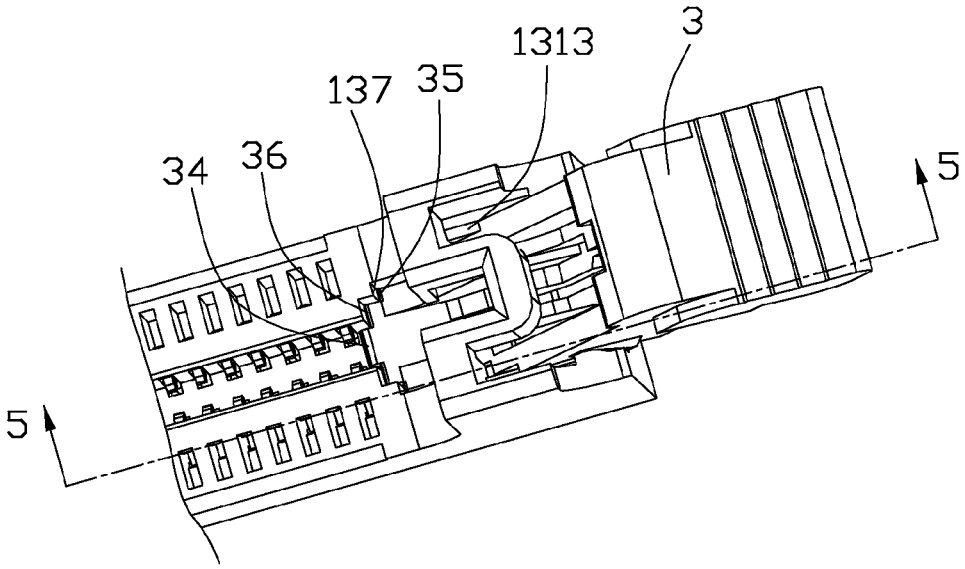
FIG. 4 is a perspective view showing an ejector being rotated outwardly from the card edge connector.
Figure 5:
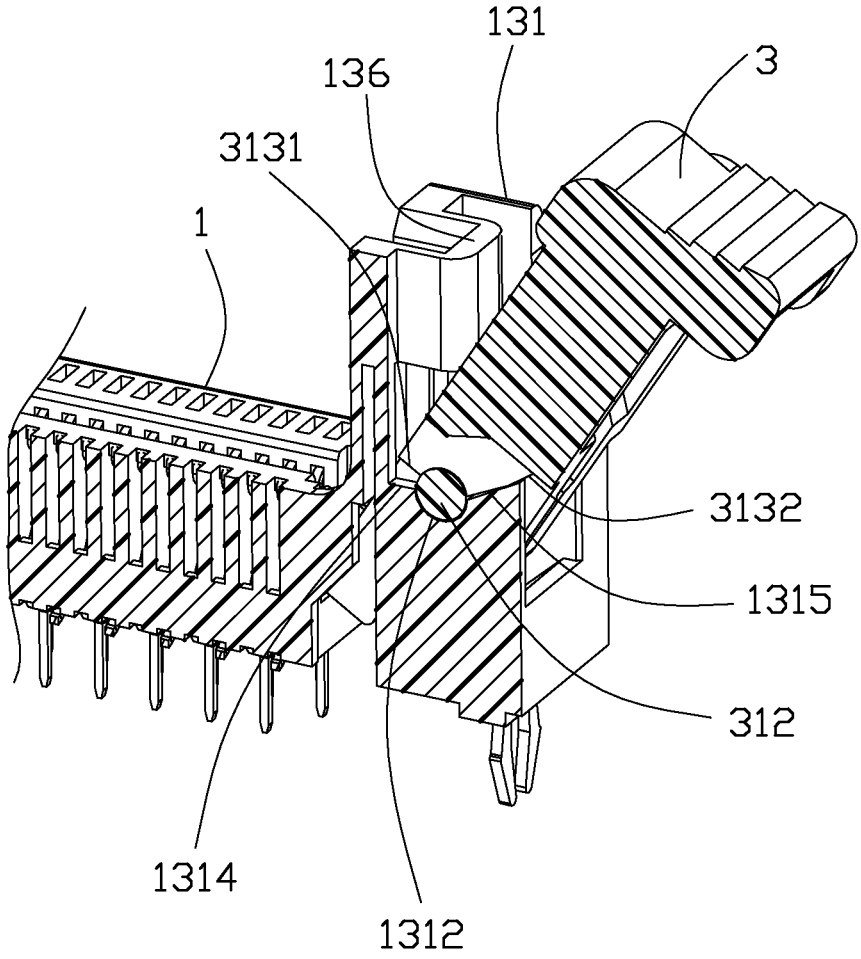
FIG. 5 is a cross-sectional view taken along line 5-5 shown in FIG. 4.
Figure 6:
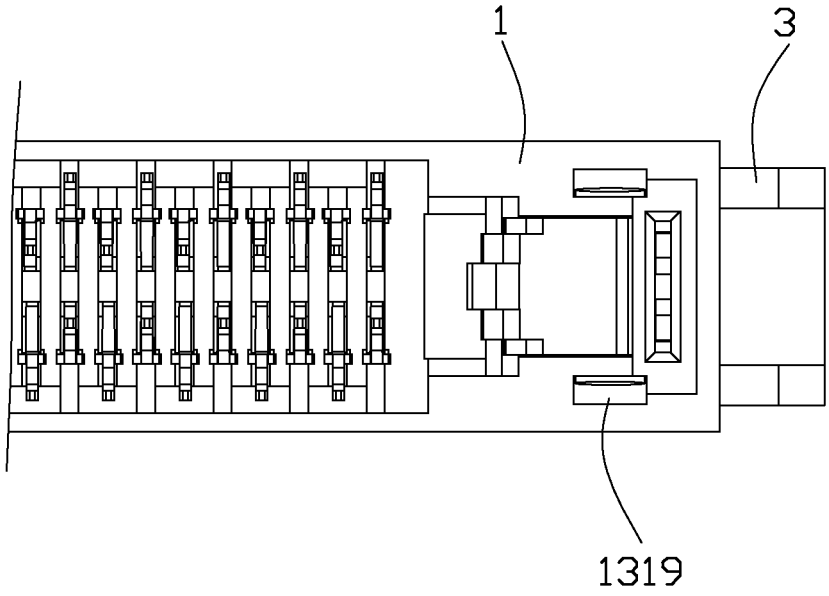
FIG. 6 is perspective view showing a bottom side of the card edge connector.
Figure 10:
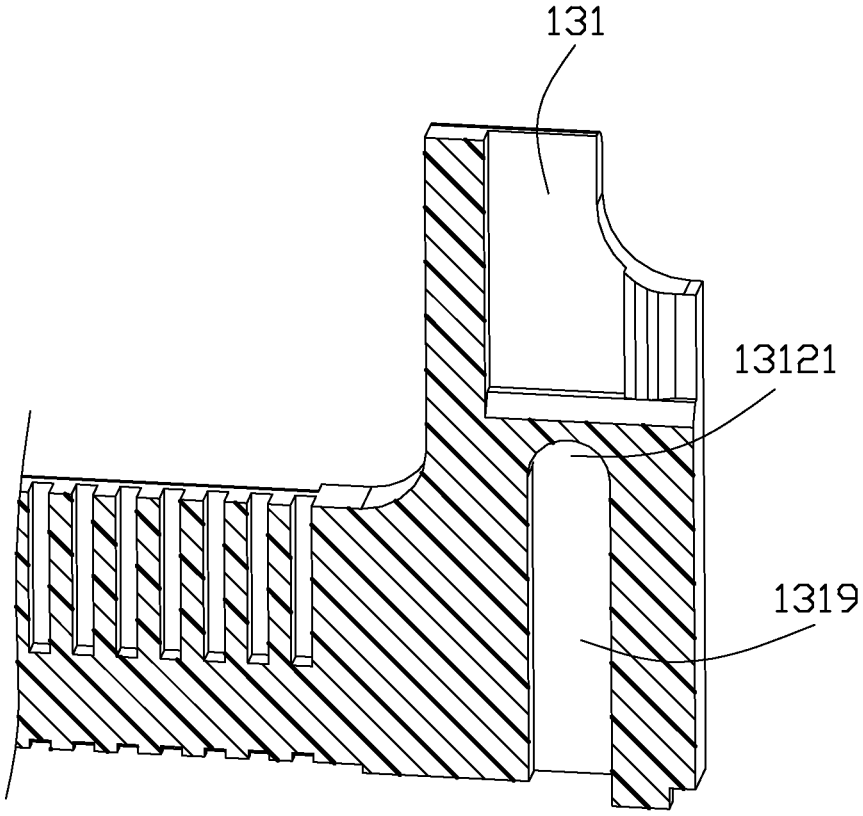
FIG. 10 is a cross-sectional view of an insulative housing showing a circular hole communicating with a aperture.

Each tower portion 13 has a pair of outer walls 131 extending in the height direction, a receiving slot or ejector receiving cavity 135 located between the outer walls 131 and communicating with the central slot 12 in the longitudinal direction, a U-shaped portion 136 connecting upper sides of the outer walls 131 and located at an inner side of the receiving slot 135, and an end wall 133 connecting lower sides of the outer walls 131 and located at an outer side of the receiving slot 135. The U-shaped portion 136 forms a groove 134 for retaining a side edge 91 of the memory module 9 and defines a guiding surface 1361 at an upper side thereof for guiding the memory module 9 into the central slot 12. Each outer wall 131 has a thick lower wall 1313 connecting the end wall 133, and a thin upper wall 1310 extending upwardly from the lower wall 1313 and connecting the U-shaped portion 136. The upper wall 1310 has a block 1311 formed thereon and facing the receiving slot 135. The lower wall 1313 has a lower portion, and an upper portion located on an upside of the lower portion and depressed away from the receiving slot 135 to form a recess 1318. The upper portion is thinner than the lower portion but thicker than the upper wall 1310. The upper portion and the lower portion form as a ladder. A circular hole 1312 includes an upper semi-circular hole 13121 formed on the upper portion and a lower semi-circular hole 13122 formed on the lower portion. Referring to FIGS. 8 and 10, the upper semi-circular hole 13121 is molded via a first mold moving upwardly in an inside of the outer wall 131 from a lower side of the outer wall 131 and forming an aperture 1319, the lower semi-circular hole 13122 is molded via a second mold moving downwardly at an inner side of the outer wall 131 from an upper side of the outer wall 131. The circular hole 1312 communicates with the receiving slot 135. The lower portion has a horizontal resisting or upward surface 1314, a stopping surface 1315 formed on the upside thereof, and a semicircular surface 1316 connecting the resisting surface 1314 and the stopping surface 1315. The resisting surface 1314 locates at an inner side of the circle hole 1312 and extends in a horizontal plane aligning to the center of the circle hole 1312 in the height direction. The stopping surface 1315 extending obliquely and located at an outer side of the circle hole 1312. Please refer to FIGS. 2 and 4, the insulative housing 1 has two steps 137 formed at an inner side of each receiving slot 135.

The contacts 2 have retaining portions 21 retained in the cavities 111, contacting portions 22 extending upwardly from the respective retaining portions 21 and protruding into the central slot 114 for mating with the memory module 9, and tail portions 23 extending downwardly from the respective retaining portions 21 for being mounted onto the printed circuit board.

Referring to FIGS. 2-9, each ejector 3 has a main portion 31 received in the receiving slot 135, an ejecting portion 34 extending from a lower end 35 of the main portion 31 for ejecting the memory module 9 out of the central slot 12, a locking portion 32 extending from an upper end of the main portion 31 for latching a cutout 911 of the memory module 200, and a lever portion 33 extending from the upper end of the main portion 31 and opposite to the locking portion 32 for being handled by a hand or others so as to operate the ejector 3 easily.

The main portion 31 has a slit 318 extending therein at an outer side thereof along the height direction to enhance its flexibility so that the ejector 3 could be assembled to the insulative housing 1 smoothly, and a chamber 319 formed at an inner side thereof to receive the U-shaped portion 136. The main portion 31 comprises an upper wide portion 310 defining a pair of protrusions 311 formed at two sides thereof for interferingly engaging with the respective blocks 1311 when the ejector 3 rotate relative to the insulative housing 1, and a lower narrow portion 315 extending downwardly from the wide portion 310 and being narrower than the wide portion 310. A pair of spindles 312 are formed at two sides of the narrow portion 315 and are rotatablely received in the corresponding circular holes 1312 so that the ejector 3 could rotate inwardly or outwardly relative to the insulative housing 1 along the longitudinal direction. The spindles 312 are sustained upwardly by the semicircular surface 1316. The narrow portion 315 has a pair of standoffs 313 formed at two lateral sides thereof and connecting the respective spindles 312 and the wide portion 310 so as to enhance intensity of the respective spindles 312. Each standoff 313 has a horizontal pressing or downward surface 3131 located at an inner side of the spindle 312 and extending in a horizontal plane aligning to the center of the spindle 312 in the height direction, and an oblique surface 3132 extending obliquely from an outer side of the spindle 312 to the wide portion 310.

Figure 3:
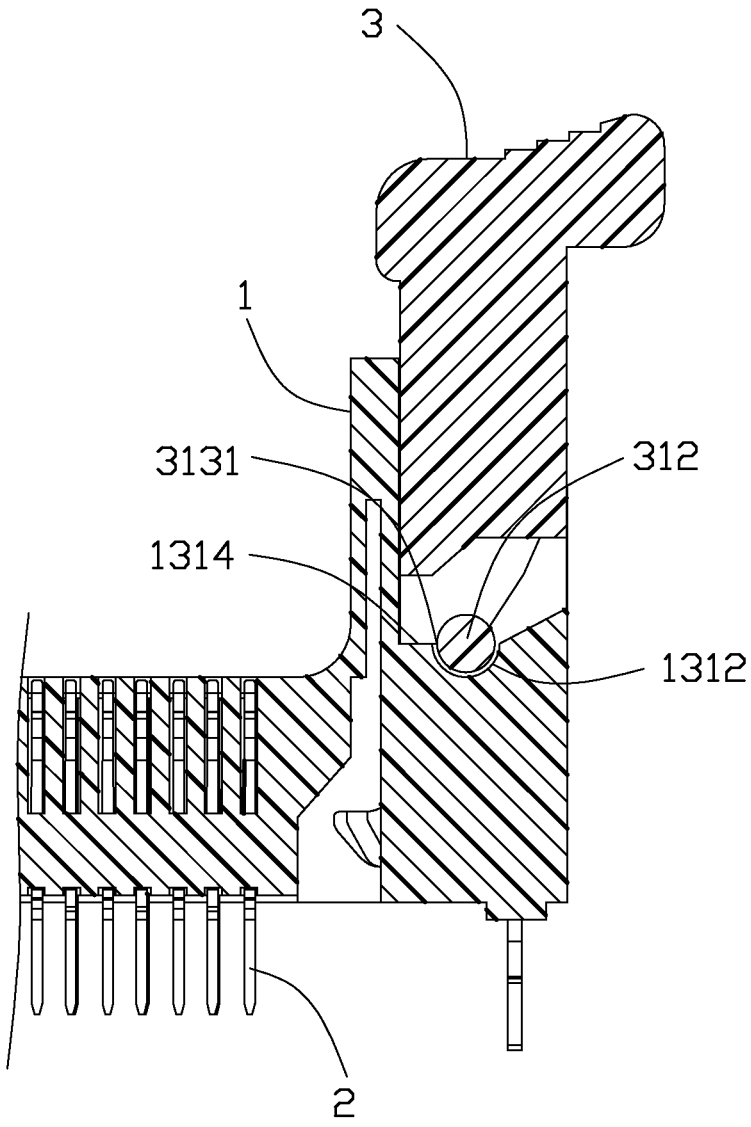
FIG. 3 is a cross-sectional view taken along line 3-3 shown in FIG. 2.

Referring to FIGS. 1-5, when the memory module 9 is being inserted into the central slot 12, the ejectors 3 rotates inwardly toward the central slot 12 from an open position as a lower edge 92 of the memory module 9 pressing the ejecting portions 34 of the ejectors 3 downwardly, each spindle 312 has a diameter smaller than that of the circular hole 1312, and the center of the spindle 312 will be lower than the center of the circular hole 1312 because of the dimensional tolerance or loose fit between the spindle 312 and the circular hole 1312, in this situation, the ejecting portion 34 will shift down and not be pressed by the lower edge 92 of the memory module 9 during the insertion of the memory module 9. When the memory module 9 is completely inserted into the central slot 12, the horizontal surfaces 3131 of the ejectors 3 abut against the resisting surfaces 1314 of the insulative housing 1 downwardly so as to align the center of the corresponding spindles 312 and circular holes 1312, therefore, the ejectors 3 could rotate inwardly to predetermined positions and latch the cutouts 911 of the memory module 9 effectively. Furthermore, the ejectors 3 could be prevented from rotating inwardly excessively via the horizontal surfaces 3131 abutting against the resisting surfaces 1314 downwardly. Referring to FIG. 3, the spindle 312 cooperate with the circular hole 1312 in a loose fit condition, therefore, the spindle 312 is suspended in the circular hole 1312. This arrangement allows relatively loose tolerance between the spindle 312 and the circular hole 1312 including the predetermined clearance therebetween advantageously. In the current embodiment, the resisting surface 1314 is designed to extend horizontally and be terminated at a circumference of the circular hole 1312 in a side view, and be located at the same level with the horizontal diameter of the circular hole. Understandably, in the current embodiment the horizontal resisting surface 1314 may not be proper to be located below the horizontal diameter; otherwise, the lower semi-circular hole 13122 may not be formed completely during injection molding. In opposite, the resisting surface 1314 may be optionally located higher than the horizontal diameter as long as being not terminated at the circumference for not blocking the injection molding. On the other hand, the resisting surface 1314 is preferably designed to be in a horizontal type for assuring no downward force component when the ejector is rotated to an inner locked position. In brief, as shown in FIG. 3 which shows the spindle 312 and the circular hole 1312 in an exaggerated manner with a larger clearance therebewteen for illustration purpose, via assistance of engagement between the resisting surface 1314 of the tower portion 13 and the horizontal surface 3131 of the ejector 3, the center of the spindle 312 can be aligned with the center of the circular hole 1312 for assuring the true position of the spindle 312, under condition that the spindle 312 is suspended in the circular hole 1312 with a tiny gap at least between the corresponding bottom portions thereof ideally and theoretically.

When the memory module 9 is being ejected from the central slot 12, the lever portions 33 are pulled out by hands or others to drive the ejector 3 rotating outwardly relative to the insulative housing 1 and ejecting the memory module 9 out via the ejecting portion 34 pushing the lower edge 92 upwardly. When the ejectors 3 rotate outwardly, the oblique surfaces 3132 of the ejectors 3 resisting the stopping surfaces 1315 of the insulative housing 1 so as to prevent the ejectors 3 from rotating outwardly excessively.

Figure 9:
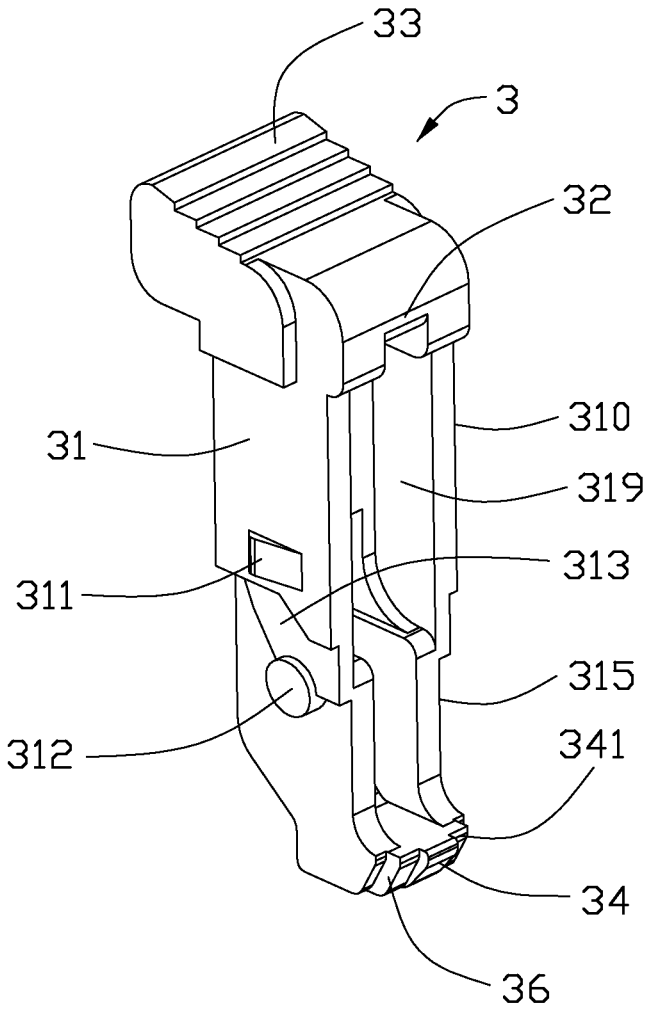
FIG. 9 is a perspective view of the ejector shown in FIG. 7.

Referring to FIG. 9, each ejecting portion 34 has a pair of ribs 341 formed at two sides thereof so as to strengthen the ejecting portion 34. The ribs 341 and the lower end 35 of the main portion 31 form two steps 36 for resisting the two steps 137 of the insulative housing 1 when the ejector 3 rotate outwardly so as to prevent the ejector 3 from over-rotation.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card edge connector comprising:

a longitudinal insulative housing having a central slot extending along a longitudinal direction for insertion of a memory module and at least one tower portion extending upwardly therefrom, the tower portion comprising a pair of outer walls extending along a height direction and a receiving slot formed between the outer walls, each outer wall defining a ladder with a circular hole formed therein;

a plurality of contacts retained in the insulative housing for mating with the memory module; and an ejector assembled to the tower portion and being rotatable inwardly or outwardly relative to the tower portion for latching the memory module into the central slot or ejecting the memory module out of the central slot, the ejector having a pair of spindles formed at two sides thereof in a transverse direction and being rotatablely received in the respective circular holes, and a pair of standoffs formed at the two sides thereof; wherein each standoff defines a horizontal surface abutting against a corresponding horizontal resisting surface formed on the ladder so as to make centers of the spindle of the ejector and the circular hole of the tower portion overlap when the ejector rotates inwardly.

2. The card edge connector according to claim 1, wherein the horizontal surface is located at an inner side of the spindle and extends in a horizontal plane aligning to the center of the spindle in the height direction, the resisting surface is located at an inner side of the circular hole and extends in a horizontal plane aligning to the center of the circular hole in the height direction.

3. The card edge connector according to claim 1, wherein the standoff integrally connecting with the corresponding spindle.

4. The card edge connector according to claim 1, wherein the spindle cooperates with the corresponding circular hole in a loose fit condition.

5. The card edge connector according to claim 1, wherein the standoff defines an oblique surface formed at an outer side thereof and resisting a corresponding stopping surface formed on the ladder so as to prevent the ejector from over-rotation when the ejector rotates outwardly.

6. The card edge connector according to claim 1, wherein the tower portion has a U-shaped portion connecting upper sides of the outer wall, the ejector comprises an upper wide portion defining a chamber formed at an inner side thereof to receive the U-shaped portion, and a lower narrow portion with the spindles and standoffs formed at two sides thereof.

7. A card edge connector comprising:

a longitudinal insulative housing having a central slot extending along a longitudinal direction for insertion of a memory module and a pair of tower portions extending upwardly from two longitudinal ends thereof, each tower portion comprising a pair of outer walls extending along a height direction and a receiving slot formed between the outer walls, each outer wall comprising a thick lower wall and a thin upper wall extending upwardly from the lower wall, the lower wall having a recess recessed at an upside thereof and a circular hole recessed on the recess;

a plurality of contacts retained in the insulative housing for mating with the memory module; and a pair of ejectors being rotatablely received in the receiving slot in the longitudinal direction, each ejector comprising a main portion, an ejecting portion extending from a lower end of the main portion for ejecting the memory module out of the central slot, a locking portion extending from an upper end of the main portion for latching the memory module into the central slot, and a lever portion extending from the upper end of the main portion and opposite to the locking portion for being handled by a hand or others easily, the main portion comprising an upper wide portion corresponding to the upper walls and a lower narrow portion corresponding to the lower walls, the narrow portion defining a pair of spindles formed at two sides thereof and being rotatablely received in the respective circular holes in a loose fit condition; wherein the narrow portion of each ejector has a pair of standoffs formed at the two sides thereof, each standoff defines a horizontal surface abutting against a corresponding horizontal resisting surface formed at a bottom side of the recess so as to align centers of the corresponding spindle and circular hole when the ejector rotates inwardly.

8. The card edge connector according to claim 7, wherein the standoff integrally connecting with the corresponding spindle.

9. The card edge connector according to claim 7, wherein the spindle is suspended in the circular hole.

10. The card edge connector according to claim 7, wherein the circular hole includes an upper semi-circular hole molded via a first mold moving upwardly in an inside of the outer wall from a lower side of the outer wall, and a lower semi-circular hole molded via a second mold moving downwardly at an inner side of the outer wall from an upper side of the outer wall.

11. The card edge connector according to claim 7, wherein the lower wall forms a lower portion, and an upper portion located on an upside of the upper portion and depressed away from the receiving slot to form the recess, the upper portion is thinner than the lower portion but thicker than the upper wall.

12. The card edge connector according to claim 11, wherein the horizontal surface is located at an inner side of the spindle and extends in a horizontal plane aligning to the center of the spindle in the height direction, the resisting surface is located at an inner side of the circular hole and extends in a horizontal plane aligning to the center of the circular hole in the height direction.

13. The card edge connector according to claim 12, wherein the standoff defines an oblique surface formed at an outer side thereof and resisting a corresponding stopping surface formed on the bottom side of the recess so as to prevent the ejector from over-rotation when the ejector rotates outwardly.

14. The card edge connector according to claim 13, wherein the lower portion has a semicircular surface connecting the resisting surface and the stopping surface to sustain the respective spindle upwardly.

15. A card edge connector for use with a memory module, comprising:

an elongated insulative housing extending along a lengthwise direction with a card receiving slot along said lengthwise direction for receiving said memory module;

a plurality of contacts disposed in the housing by at least one side of the card receiving slot;

a tower portion formed at one end of the housing and defining an ejector receiving cavity between two sides thereof in a transverse direction perpendicular to said lengthwise direction;

a pair of circular holes formed in the tower portion and located by two sides of the ejector receiving cavity, each of said circular holes being formed, in said transverse direction, by an upper semi-circular surface in an outer side and a lower semi-circular surface in an inner side in an intimate side by side manner;

an upward resisting surface formed on an inner face of each side of the tower portion beside the circular hole in a side view along the transverse direction while aligned with the lower semi-circular surface in the lengthwise direction; and an ejector pivotally located in the corresponding ejector receiving cavities, respectively, said ejector defining, on each of two opposite sides thereof, a circular spindle diametrically smaller than the circular hole for pivoting the ejector with regard to the housing, an upper locking portion for locking into a notch of said memory module, a lower ejection portion for ejecting said memory module, and a downward pressing surface located beside the spindle; wherein when the ejector is rotated to an inner locking position, the downward pressing surface of the ejector abuts against the upward resisting surface of the tower portion, and thus ideally and theoretically a center of the spindle is aligned with a center of the circular hole with a tiny gap between bottom portions of said spindle and said circular hole.

16. The card edge connector as claimed in claim 15, wherein the upward resisting surface is located at essentially a same level with a horizontal diameter of the circular hole.

17. The card edge connector as claimed in claim 15, wherein the upward resisting surface and the lower semi-circular surface have a same dimension in the transverse direction.

18. The card edge connector as claimed in claim 15, wherein the upward resisting surface is terminated at a circumference of the lower semi-circular surface, and the downward pressing surface is terminated at a circumference of the circular spindle.

19. The card edge connector as claimed in claim 18, wherein said upward resisting surface extends horizontally.

20. The card edge connector as claimed in claim 19, wherein said downward pressing surface extends horizontally.

* * * * *